US007946099B2

(12) United States Patent
Sparakowski et al.

(10) Patent No.: US 7,946,099 B2
(45) Date of Patent: May 24, 2011

(54) METHOD FOR PRODUCING A PACKAGE AND PACKAGING MACHINE

(75) Inventors: Helmut Sparakowski, Tannheim (DE); Jesus Sanchez, Haldenwang (DE); Tobias Thiele, Berlin (DE)

(73) Assignee: Multivac Sepp Haggenmueller GmbH & Co. KG (DE)

( * ) Notice: Subject to any disclaimer, the term of this patent is extended or adjusted under 35 U.S.C. 154(b) by 120 days.

(21) Appl. No.: 12/292,013

(22) Filed: Nov. 10, 2008

(65) Prior Publication Data

US 2010/0115893 A1 May 13, 2010

(51) Int. Cl.
*B65B 31/02* (2006.01)

(52) U.S. Cl. ..... 53/432; 53/510; 53/284.5; 426/112; 426/392

(58) Field of Classification Search ..... 53/432, 53/433, 403, 79, 111 R, 510, 511, 559, 140, 53/167, 574, 284.5, 398.2, 558, 561, 579; 426/106, 112, 665, 392, 396
See application file for complete search history.

(56) References Cited

U.S. PATENT DOCUMENTS 2,965,494 A * 12/1960 Williams ..... 426/234
3,481,100 A * 12/1969 Bergstrom ..... 53/433
3,492,773 A * 2/1970 Bergstrom ..... 53/433
3,851,080 A * 11/1974 Lugg et al. ..... 26/312
3,930,040 A * 12/1975 Woodruff ..... 426/312
3,956,867 A * 5/1976 Utz et al. ..... 53/433
4,642,239 A * 2/1987 Ferrar et al. ..... 426/396
4,919,955 A * 4/1990 Mitchell ..... 426/394
4,958,480 A * 9/1990 Warner ..... 53/433
5,103,618 A * 4/1992 Garwood ..... 53/433
5,115,624 A * 5/1992 Garwood ..... 53/427
5,402,622 A * 4/1995 Stockley et al. ..... 53/427
6,210,730 B1 * 4/2001 Mitchell ..... 426/312
6,521,275 B1 * 2/2003 Mercogliano et al. ..... 426/316
7,290,380 B2 11/2007 Natterer

OTHER PUBLICATIONS

K.W. McMillin; *Where is MAP Going? A Review And Future Potential Of Modified Atmosphere Packaging For Meat*; Meat Science, vol. 80, pp. 43-65 (2008).

* cited by examiner

*Primary Examiner* — Paul R Durand
(74) *Attorney, Agent, or Firm* — Brooks Kushman P.C.

(57) ABSTRACT

A method for producing a package with an inner volume of the package containing a headspace volume and a volume taken by the product, and a packaging machine. To allow the reduction of the size of such a package, the package is formed providing a product to be packaged inside the package; providing a tray with its height being smaller than the maximum height of the product; placing the product into the tray; replacing the atmosphere surrounding the product by a gas mixture of carbon monoxide, carbon dioxide, and nitrogen; covering the tray containing the product by a formable sheet material; forming the formable sheet material and sealing tray together with the formable sheet material, so that the headspace volume containing the gas mixture makes at most half of the volume taken by the product inside the package.

15 Claims, 2 Drawing Sheets

METHOD FOR PRODUCING A PACKAGE AND PACKAGING MACHINE

FIELD OF THE INVENTION

The present invention relates to a method for producing a package and to a packaging machine.

BACKGROUND OF THE INVENTION

Packaging machines, so-called tray closing machines are known in which products are packaged into pre-fabricated tray-shaped containers and closed with a film, for example from U.S. Pat. No. 7,290,380 B2. Furthermore, packaging machines that are able to form trays themselves from sheet material are known.

From a review article written by K. W. McMillin, '*Where is MAP Going? A review and future potential of modified atmosphere packaging for meat*', published in Meat Science in the year of 2008, Vol. 80, pp. 43-65, several methods about modified atmosphere packaging (MAP), especially for meat products, have been known and discussed. Using the definition of the article, MAP is the removal and/or the replacement of the atmosphere surrounding the product before sealing in vapor-barrier materials. In general, a package protects products like meat against deteriorative effects including discoloration, off-flavor, off-odor development, nutrient loss, texture changes, pathogenicity, and other measurable factors. Usually, the consumer's decision whether to buy such a product depends on his optical impression of the product, preferably a bloomed red meat color as an important quality attribute.

On top of that, raw chilled meat during storage exhibits the chemical reactions of respiration, which is the active absorption of oxygen and release of carbon dioxide, but not as pronounced as for example for a muscle that is still alive. According to the article, it is generally supposed that the headspace must be approximately 1.5-2 times the meat volume and package collapse is to be prevented by headspace gas to meat volumes of 2 to 3. This is influenced by the absorption and the evolution of gas (e.g. oxygen, carbon dioxide, etc.).

In order to obtain the red meat color, commercially available packages typically contain a permeable film, usually leading to a very short shelf life. To prolong the shelf life, a so-called 'motherbag' is often used, which means a secondary packaging to have a low oxygen atmosphere during distribution. In the shops, the single packs are unpacked and the meat can start to bloom. Nevertheless, a difficulty with re-blooming of meat in such packages after low oxygen MAP storage has been inability to bloom and/or lack of color uniformity.

According to the pre-mentioned article, it is further known to use high-oxygen packages with a content of typically 60-80% oxygen, so that oxymyoglobin pigments can be maintained. Unfortunately, other oxidative reactions reducing the shelf life may be induced, too.

SUMMARY OF THE INVENTION

It is an object of this invention to provide a method for producing a package and a packaging machine in a manner which allows the reduction of the size of such a package.

The object is attained by a method for producing a package and a packaging machine according to embodiments of the invention as set forth below and specified in the claims.

The method for producing a package and the packaging machine according to invention have the advantage of reducing the headspace of the inner volume, where the product, especially the meat product, has been placed, too.

Thereby, a further advantage of the invention is the possibility of reducing the costs for such a package, because the necessary quantity of film or sheet material can be reduced in addition. Furthermore, in contrast to the usage of the described motherbag, the costs can additionally be reduced, because neither such a secondary package is needed any longer nor does the handling to pack it with the motherbag and unpack this motherbag again.

The reduction of the headspace is accompanied by the usage of a special gas mixture to surround the product. This gas mixture comprises carbon monoxide (CO), carbon dioxide ($CO_2$) and nitrogen ($N_2$).

A further advantage of the invention is the usage of carbon monoxide which helps preserving the bloomed red meat color and which is applied in small concentrations of less than 5% with respect to the volume. Advantageously, the carbon dioxide has antimicrobial effects.

The most preferable embodiment uses an anoxic gas mixture. The advantage of reducing the oxygen in the atmosphere as much as possible is to improve the shelf life.

The covering sheet material is a formable film, which can be for example a material that can be used to form trays, but also for example a shrinkable material, in principle any top web forming process to thermo-form such a film or sheet material. If the used sheet material from the top web is shrinkable, shrinking itself is usually done in a separate apparatus after having produced and separated the packages.

Furthermore, a packaging machine according to the invention can comprise a forming station to form trays where the product is put in or can be structured in a way that it is provided with formed trays, especially with trays where the product has already been put in.

BRIEF DESCRIPTION OF THE DRAWINGS

Further features and advantages of the invention will arise from the description of embodiments with reference to the enclosed figures. The figures show.

DETAILED DESCRIPTION OF EMBODIMENTS OF THE INVENTION

Figure 1:
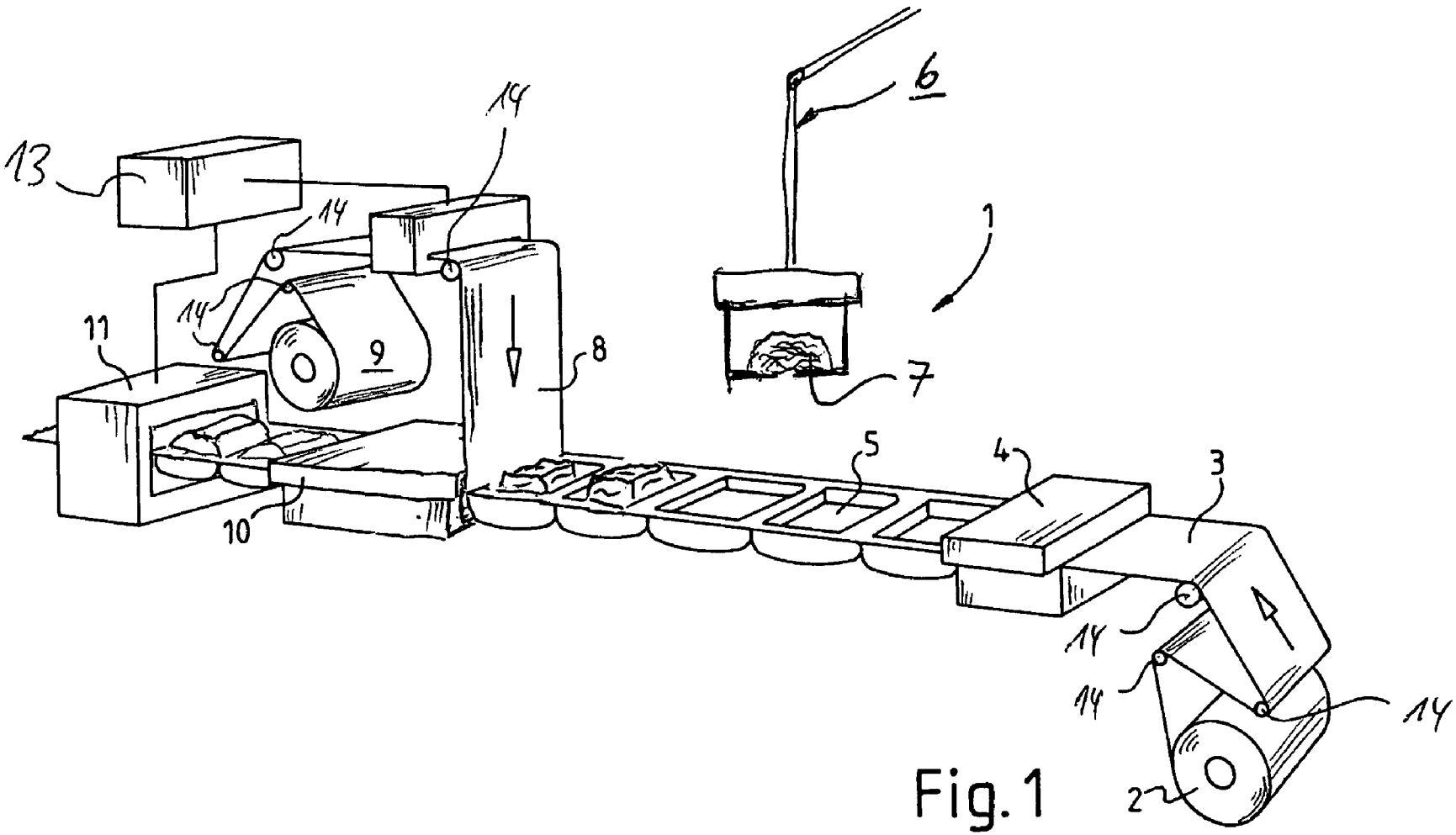
FIG. 1: a perspective view of a schematic illustration of a packaging according to one embodiment of the invention.

As shown in FIG. 1, the packaging machine 1 of this embodiment includes a web 3 of thin thermoplastic material, which is advanced from a roll 2. Suitable rollers 14 are used for routing the web 2 from the supply roll 2. The machine 1 includes a forming station 4 where trays, pockets or cavities 5 are formed in the web.

A piece of ground meat 7 is put into the pocket 5, here by a robot arm 6. A covering web 8 covers the tray 5 with the ground meat 7. In the station 10, the atmosphere is replaced by a gas mixture of 5% CO, 25% $CO_2$, and 70% $N_2$. Furthermore, the station 10 forms the covering web 8. Typically, shrinking the covering film 8 to fit to the tray 5 and the meat product 7 inside is done in a separate apparatus after having produced the separate packages. The gas itself is anoxic to reduce oxidative chemical processes reducing the shelf life. The covering web 8 and the web 3 with the trays 5 are sealed.

The packages are separated in the cutting station 11.

Figure 2:
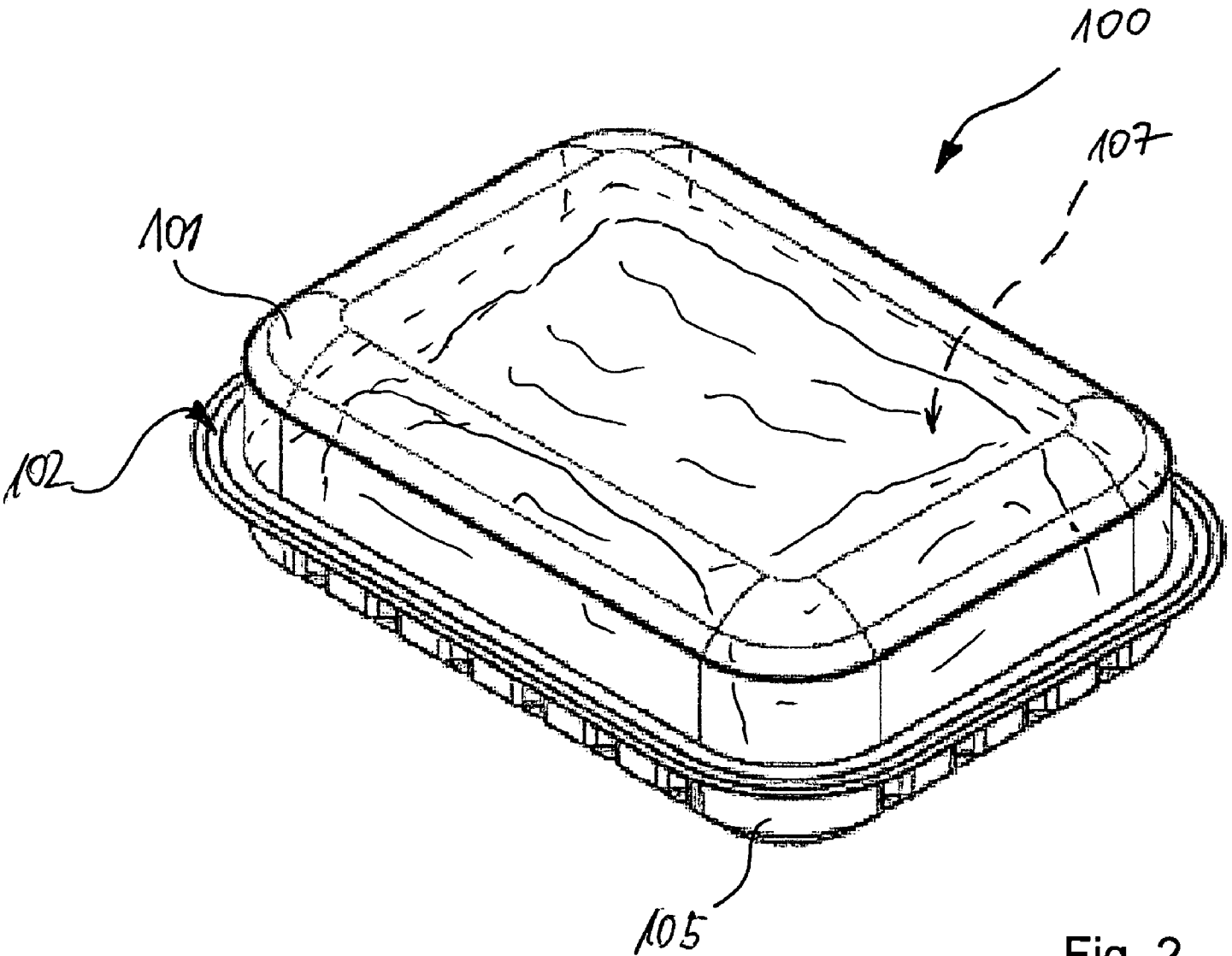
FIG. 2: a perspective view of a schematic illustration of a package formed according to one embodiment of the invention.

FIG. 2 shows a package 100, which consists of a tray 105 and a covering film 101 that are sealed together at the region 102. Inside ground meat 107 is packaged inside the package

100. The package 100 contains the same anoxic atmosphere as described above for the packages formed by the packaging machine 1. The headspace volume of the package 100 is smaller 0.5 times the volume of the ground meat inside. The formed covering film 101 is not too tight, so that diffusion processes inside the package 100 are still possible. This allows the meat to have a homogeneous color. If the film was to tight and in contact with the meat, this might cause the meat to show spots of different color due to the fact that the gas, for example CO, does not come into contact with those parts.

A further advantage is that an embodiment of the invention abandons the prejudice that the headspace must be 1.5-3 times larger than the volume taken by the meat product.

Especially formed states of myoglobin play an important role in the appearance of a packaged meat product. Deoxymyoglobin is the reduced form of myoglobin (bivalent iron cation, $Fe^{2+}$) that gives purple color in the absence of oxygen when meat is first cut or has been vacuum packaged. Metmyoglobin is the oxidized pigment state of myoglobin, the dominant sarcoplasmic pigment in muscle, and the trivalent iron cation $Fe^{3+}$ results in a brown or gray meat color. Oxymyoglobin is the reduced pigment form (bivalent iron cation $Fe^{2+}$) in which oxygen occupies the ligand position and the perceived color is red (bloomed). Carboxymyoglobin is formed when deoxymyoglobin is exposed to CO.

CO in the package 100 makes the meat appear in bloomed red color.

What is claimed is:

1. A method for producing a package for a product, wherein the package has an inner volume containing a headspace volume and a volume taken by the product, the method comprising:

providing a tray having a height that is smaller than a maximum height of the product;

placing the product into the tray;

introducing an anoxic gas mixture of carbon monoxide (CO), carbon dioxide ($CO_2$), and nitrogen ($N_2$) into the tray, wherein the gas mixture does not include oxygen;

covering the tray containing the product by a formable sheet material;

forming the formable sheet material and sealing the tray together with the formable sheet material to form the package, so that the headspace volume containing the gas mixture makes at most half of the volume taken by the product inside the package.

2. The method of claim 1, wherein the step of providing a tray comprises forming sheet material to a tray.

3. The method of claim 1 or 2, wherein the step of covering the tray containing the product by a formable sheet material is performed using a shrinkable sheet material.

4. The method of claim 3, further comprising shrinking the shrinkable sheet material after the step of sealing the tray together with the formable sheet material.

5. The method of claim 1, wherein the gas mixture comprises 5% CO at most, 20-40% $CO_2$, and 55-80% $N_2$ with respect to volume.

6. The method of claim 1, wherein the steps of providing a tray and of covering the tray are performed using sheet material and formable sheet material acting as barrier films for gas.

7. The method of claim 1, wherein the gas mixture comprises 5% CO at most.

8. The method of claim 1, wherein the gas mixture is made up entirely of CO, $CO_2$ and $N_2$.

9. A packaging machine for packaging a product in a package with an inner volume of the package containing a headspace volume and a volume taken by the product, the packaging machine comprising:

a supply device for supplying a tray to receive the product, wherein the tray has a height that is smaller than a maximum height of the product;

a purging device, which is structured to introduce an anoxic gas mixture of carbon monoxide (CO), carbon dioxide ($CO_2$), and nitrogen ($N_2$) into the tray, wherein the gas mixture does not include oxygen; and a closing device which is structured to cover the tray containing the product by a formable sheet material, to form the formable sheet material and to seal the tray and the formable sheet material together to form the package, so that the headspace volume containing the gas mixture makes at most half of the volume taken by the product inside the package.

10. A packaging machine according to claim 9, wherein the supply device comprises a forming device that forms sheet material to form the tray.

11. A packaging machine according to claim 9 or 10, wherein the formable sheet material is a shrinkable sheet material.

12. A packaging machine according to claim 10, wherein the sheet material and the formable sheet material are barrier films for gas.

13. A packaging machine according to claim 9, wherein the gas mixture comprises 5% CO at most, 20-40% $CO_2$, and 55-80% $N_2$ with respect to volume.

14. A packaging machine according to claim 9, wherein the gas mixture comprises 5% CO at most.

15. The packaging machine according to claim 9, wherein the gas mixture is made up entirely of CO, $CO_2$ and $N_2$.

* * * * *